US009412320B2

(12) United States Patent
Chen et al.

(10) Patent No.: US 9,412,320 B2
(45) Date of Patent: Aug. 9, 2016

(54) METHOD FOR ADJUSTING DISPLAY BACKLIGHT WITH AID OF AMBIENT LIGHT BRIGHTNESS DETECTION AND TIME DETECTION, AND ASSOCIATED APPARATUS AND ASSOCIATED COMPUTER PROGRAM PRODUCT

(71) Applicant: HTC Corporation, Taoyuan County (TW)

(72) Inventors: Po-Ting Chen, Taoyuan County (TW); Cheng-Hao Chin, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 13/974,058

(22) Filed: Aug. 23, 2013

(65) Prior Publication Data

US 2015/0054725 A1 Feb. 26, 2015

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 2330/022* (2013.01); *G09G 2360/144* (2013.01)

(58) Field of Classification Search
CPC combination set(s) only.
See application file for complete search history.

(56) References Cited

U.S. PATENT DOCUMENTS 8,610,659 B2 * 12/2013 Fletcher ..... G06F 1/3203 345/102
2006/0192748 A1 * 8/2006 Lowles et al. ..... 345/102
2007/0279369 A1 12/2007 Yao
2008/0165116 A1 * 7/2008 Herz ..... G09G 3/3406 345/102
2009/0140971 A1 6/2009 Hernandez
2013/0231161 A1 * 9/2013 Hsu ..... G09G 3/3406 455/566

FOREIGN PATENT DOCUMENTS

CN 101425262 A 5/2009
CN 102496351 A 6/2012
JP 2010122567 A 6/2010
TW 201138457 11/2011

OTHER PUBLICATIONS

Office action mailed on Jun. 5, 2014 for the Germany application No. 102013017098.2, p. 1-4.
Office action mailed on Apr. 20, 2015 for the Taiwan application No 102142299, filing date Nov. 20, 2013, p. 1-7.
Office action mailed on May. 4, 2016 for the China application No. 201410041466.6, filed Jan. 28, 2014, p. 1-11.

* cited by examiner

*Primary Examiner* — Jason Olson
*Assistant Examiner* — Krishna Neupane
(74) *Attorney, Agent, or Firm* — Winston Hsu; Scott Margo

(57) ABSTRACT

A method and apparatus for adjusting display backlight and an associated computer program product are provided. The method is applied to an electronic device. The method includes the steps of: utilizing at least one light sensor of the electronic device to detect ambient light; and performing a plurality of detection operations to selectively control the electronic device to enter a specific mode to adjust brightness level of a backlight module of a display panel of the electronic device. The detection operations includes: detecting whether the ambient light is less than a predetermined ambient brightness threshold value for a time period; and detecting whether a length of the time period reaches a predetermined time threshold value. For example, the specific mode can be a low-light mode, which is suitable for a user who has stayed in the dark for a time period (e.g. tens of minutes, or one or more hours).

17 Claims, 8 Drawing Sheets

METHOD FOR ADJUSTING DISPLAY BACKLIGHT WITH AID OF AMBIENT LIGHT BRIGHTNESS DETECTION AND TIME DETECTION, AND ASSOCIATED APPARATUS AND ASSOCIATED COMPUTER PROGRAM PRODUCT

BACKGROUND OF THE INVENTION

1. Field of the Invention

The present invention relates to backlight control of a display panel of a portable electronic device, and more particularly, to a method for adjusting display backlight, and to an associated apparatus and an associated computer program product.

2. Description of the Prior Art

A conventional portable electronic device implemented according to the related art, such as a multifunctional mobile phone equipped with personal digital assistant (PDA) functionalities or a PDA equipped with mobile phone functionalities, may have become an important part of everyday life since it is very helpful. In a situation where the conventional portable electronic device is utilized for showing something to the user in the dark, some problems may occur. For example, the user enters a dark room and stays in the dark room for a period of time (e.g. thirty minutes, or an hour), and then, when the user starts using the conventional portable electronic device, the user may feel that the brightness of the content displayed on the display panel of the conventional portable electronic device is too high. In another example, when the user is woken by an incoming phone call at midnight and the user would like to read the information displayed on the display panel of the conventional portable electronic device in order to determine whether to answer this phone call, the user may feel uncomfortable since the display panel is too bright for the user. Thus, a novel method is required for providing backlight control over an electronic device.

SUMMARY OF THE INVENTION

It is therefore an objective of the claimed invention to provide a method for adjusting display backlight, and to provide an associated apparatus and an associated computer program product, in order to solve the above-mentioned problems.

According to at least one preferred embodiment, a method for adjusting display backlight is provided, where the method is applied to an electronic device. The method comprises the steps of: utilizing at least one light sensor of the electronic device to detect ambient light brightness; and controlling a brightness level of a backlight module of a display panel of the electronic device to automatically switch to be one of a plurality of predetermined levels of an automatic backlight mode in response to the ambient light brightness before the electronic device enters a specific mode, and performing a plurality of detection operations to selectively control the electronic device to enter the specific mode to adjust the brightness level of the backlight module of the display panel of the electronic device. More particularly, the plurality of detection operations comprises: detecting whether the ambient light brightness is less than a predetermined ambient brightness threshold value for a time period; and detecting whether a length of the time period reaches a predetermined time threshold value. For example, the step of performing the plurality of detection operations to selectively control the electronic device to enter the specific mode may further comprise: when it is detected that the ambient light brightness is less than the predetermined ambient brightness threshold value for the time period and that the length of the time period reaches the predetermined time threshold value, controlling the electronic device to enter the specific mode. In another example, the plurality of detection operations may further comprise detecting whether a system time of the electronic device is within a predetermined time interval of a day, and the step of performing the plurality of detection operations to selectively control the electronic device to enter the specific mode may further comprise: when it is detected that the ambient light brightness is less than the predetermined ambient brightness threshold value for the time period and that the length of the time period reaches the predetermined time threshold value and that the system time of the electronic device is within the predetermined time interval of the day, controlling the electronic device to enter the specific mode.

According to at least one preferred embodiment, an apparatus for adjusting display backlight is also provided, where the apparatus comprises at least one portion of an electronic device. The apparatus comprises a display panel and at least one light sensor, and further comprises a processing circuit, coupled to the display panel and the at least one light sensor. The display panel is arranged to display information for the electronic device, and the at least one light sensor is arranged to detect ambient light brightness for the electronic device. In addition, the processing circuit is arranged to control operations of the electronic device, wherein the processing circuit controls a brightness level of a backlight module of the display panel to automatically switch to be one of a plurality of predetermined levels of an automatic backlight mode in response to the ambient light brightness before the electronic device enters a specific mode. Additionally, the processing circuit performs a plurality of detection operations to selectively control the electronic device to enter the specific mode to adjust the brightness level of the backlight module of the display panel. More particularly, the plurality of detection operations comprises: detecting whether the ambient light brightness is less than a predetermined ambient brightness threshold value for a time period; and detecting whether a length of the time period reaches a predetermined time threshold value. For example, when it is detected that the ambient light brightness is less than the predetermined ambient brightness threshold value for the time period and that the length of the time period reaches the predetermined time threshold value, the processing circuit controls the electronic device to enter the specific mode. In another example, the plurality of detection operations further comprises detecting whether a system time of the electronic device is within a predetermined time interval of a day, and when it is detected that the ambient light brightness is less than the predetermined ambient brightness threshold value for the time period and that the length of the time period reaches the predetermined time threshold value and that the system time of the electronic device is within the predetermined time interval of the day, the processing circuit controls the electronic device to enter the specific mode.

According to at least one preferred embodiment, a computer program product is also provided, where the computer program product has program instructions for instructing a processor of an electronic device to perform a method comprising the steps of: utilizing at least one light sensor of the electronic device to detect ambient light brightness; and controlling a brightness level of a backlight module of a display panel of the electronic device to automatically switch to be one of a plurality of predetermined levels of an automatic backlight mode in response to the ambient light brightness before the electronic device enters a specific mode, and performing a plurality of detection operations to selectively control the electronic device to enter the specific mode to adjust the brightness level of the backlight module of the display panel of the electronic device. More particularly, the plurality of detection operations comprises: detecting whether the ambient light brightness is less than a predetermined ambient brightness threshold value for a time period; and detecting whether a length of the time period reaches a predetermined time threshold value. For example, the step of performing the plurality of detection operations to selectively control the electronic device to enter the specific mode may further comprise: when it is detected that the ambient light brightness is less than the predetermined ambient brightness threshold value for the time period and that the length of the time period reaches the predetermined time threshold value, controlling the electronic device to enter the specific mode. In another example, the plurality of detection operations may further comprise detecting whether a system time of the electronic device is within a predetermined time interval of a day, and the step of performing the plurality of detection operations to selectively control the electronic device to enter the specific mode may further comprise: when it is detected that the ambient light brightness is less than the predetermined ambient brightness threshold value for the time period and that the length of the time period reaches the predetermined time threshold value and that the system time of the electronic device is within the predetermined time interval of the day, controlling the electronic device to enter the specific mode.

It is an advantage of the present invention that the aforementioned method, the aforementioned apparatus, and the aforementioned computer program product may control the brightness of the content displayed on the display panel of the electronic device to an extremely low level which is suitable for a user who has stayed in the dark for a period of time (e.g. tens of minutes, or one or more hours). In addition, the aforementioned method, the aforementioned apparatus, and the aforementioned computer program product allow the user of the electronic device to view the content displayed on the display panel of the electronic device with ease. Additionally, the related art problems can be prevented.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
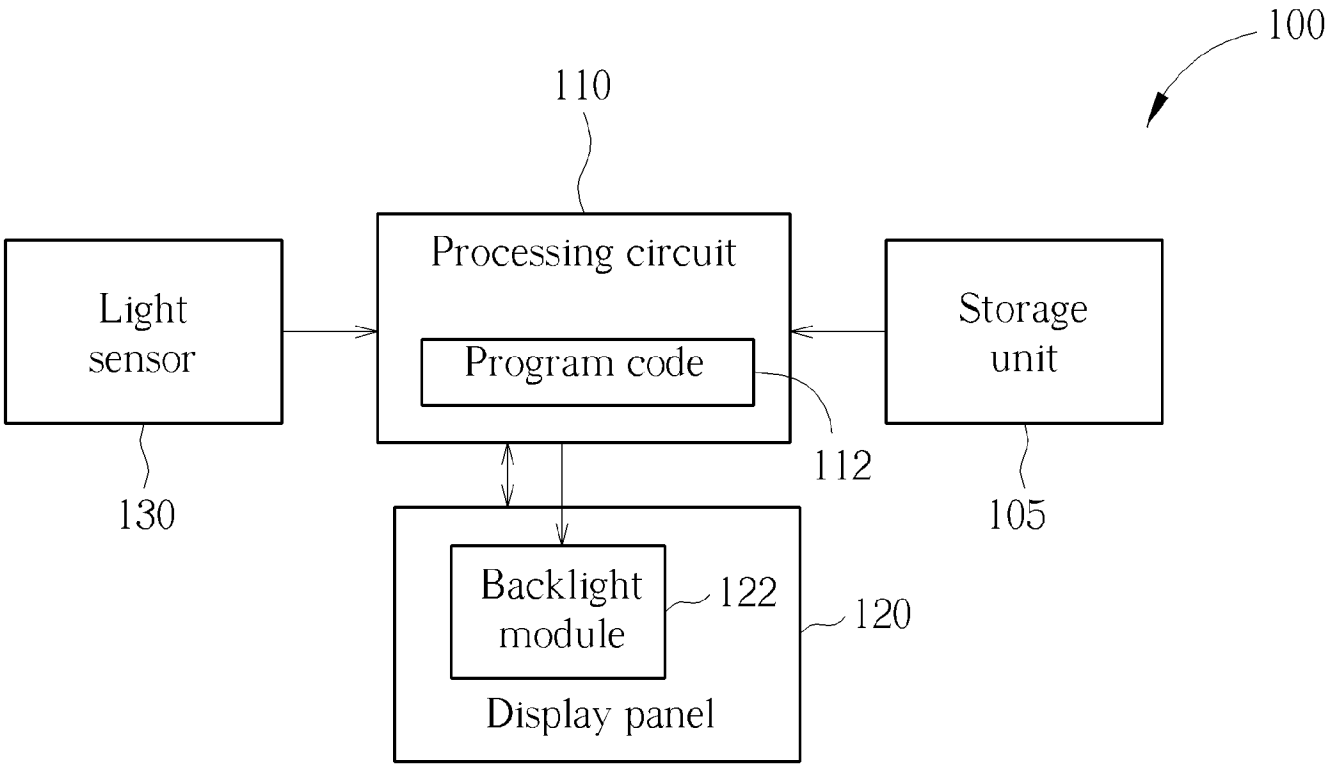
FIG. 1 is a diagram of an apparatus for adjusting display backlight according to an example.

Please refer to FIG. 1, which illustrates a diagram of an apparatus 100 for adjusting display backlight according to an example, where the apparatus 100 may comprise at least one portion (e.g. a portion or all) of an electronic device. For example, the apparatus 100 may comprise a portion of the electronic device mentioned above, and more particularly, can be a control circuit such as an integrated circuit (IC) within the electronic device. In another example, the apparatus 100 can be the whole of the electronic device mentioned above. Examples of the electronic device may include, but not limited to, a mobile phone (e.g. a multifunctional mobile phone), a mobile computer (e.g. tablet computer), a personal digital assistant (PDA), and a personal computer such as a laptop computer or desktop computer.

As shown in FIG. 1, the apparatus 100 comprises a storage unit 105, a processing circuit 110, a display panel 120, and at least one light sensor 130 such as one or more light sensors (which can be collectively referred to as the light sensor 130, for brevity), where the display panel 120 comprises a backlight module 122. For example, the display panel 120 can be a touch-sensitive display panel which comprises a liquid crystal display (LCD) module comprising the backlight module 122. In another example, in a situation where the display panel 120 is not a touch-sensitive display panel, the display panel 120 may comprise an LCD module comprising the backlight module 122. According to this example, the storage unit 105 is arranged to store information for the electronic device, the processing circuit 110 is arranged to control operations of the electronic device, the display panel 120 is arranged to display information for the electronic device, and the light sensor 130 is arranged to detect ambient light brightness for the electronic device. Please note that the processing circuit 110 can be selectively implemented with the mixed scheme utilizing software (or firmware) module running on hardware circuit(s), or implemented with the pure hardware scheme. For example, the processing circuit 110 may comprise a processor and associated hardware circuits implemented by using at least one printed circuit board (PCB) on which the processor can be installed, and the storage unit 105 may comprise at least one memory such as at least one random access memory (RAM) and/or at least one non-volatile memory (e.g. an electrically erasable programmable read only memory (EEPROM) or a Flash memory), where the program code 112 may be stored in the storage unit 105 in advance and retrieved by the processing circuit 110, for running on the processing circuit 110 as illustrated in FIG. 1. This is for illustrative purposes only, and is not meant to be a limitation. In another example, the processing circuit 110 may be implemented as pure hardware circuit(s), where the program code 112 is imbedded therein.

The processing circuit 110 (more particularly, the processing circuit 110 executing the program code 112 such as an application, an operating system and hardware drivers) is capable of utilizing the light sensor 130 to detect ambient light brightness, and selectively controlling the electronic device to enter a specific mode to adjust the brightness level of the backlight module 122 at least according to ambient light brightness detection and time detection, for properly controlling the overall brightness of the display panel 120 to be suitable for the user of the electronic device in different situations, respectively.

Figure 2:
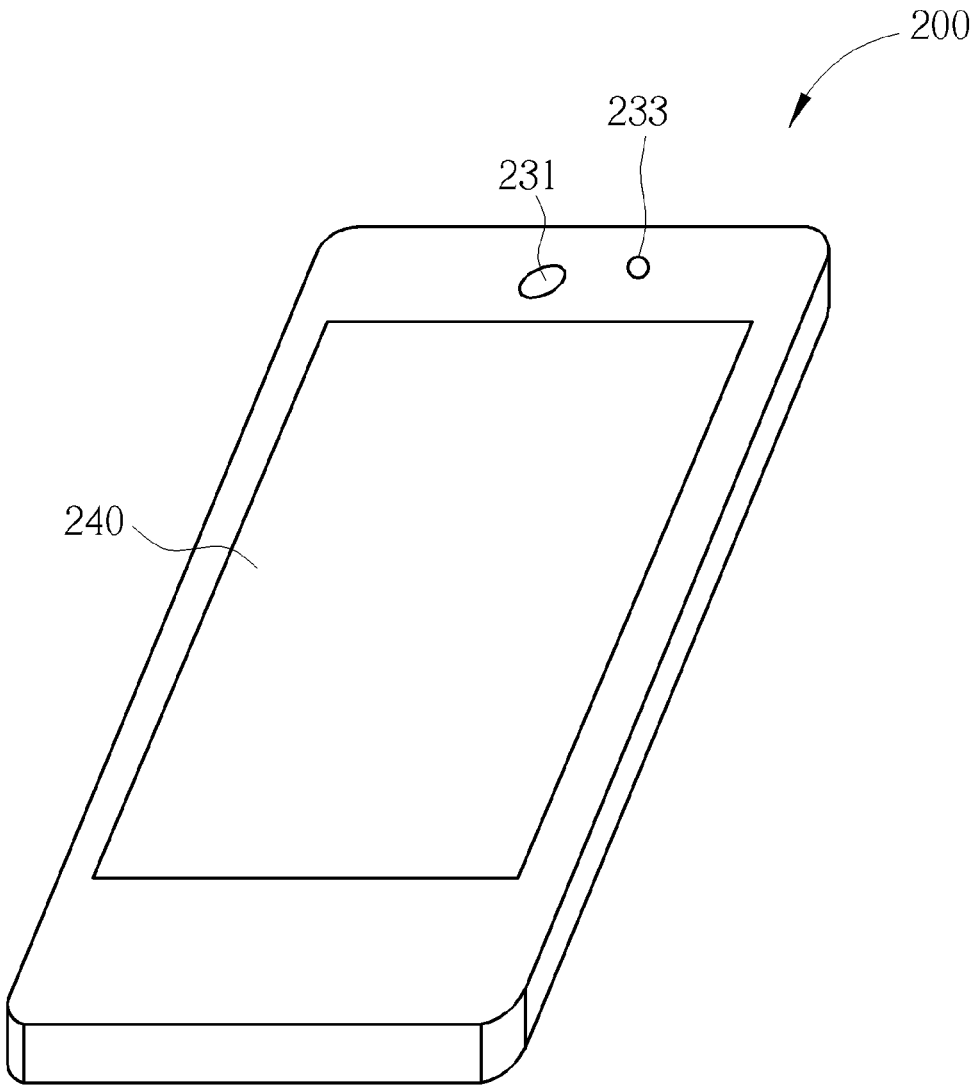
FIGS. 2-3 illustrate some implementation details of the apparatus shown in FIG. 1 according to an example, where the apparatus of this example is a mobile phone equipped with multiple light sensors.
Figure 3:
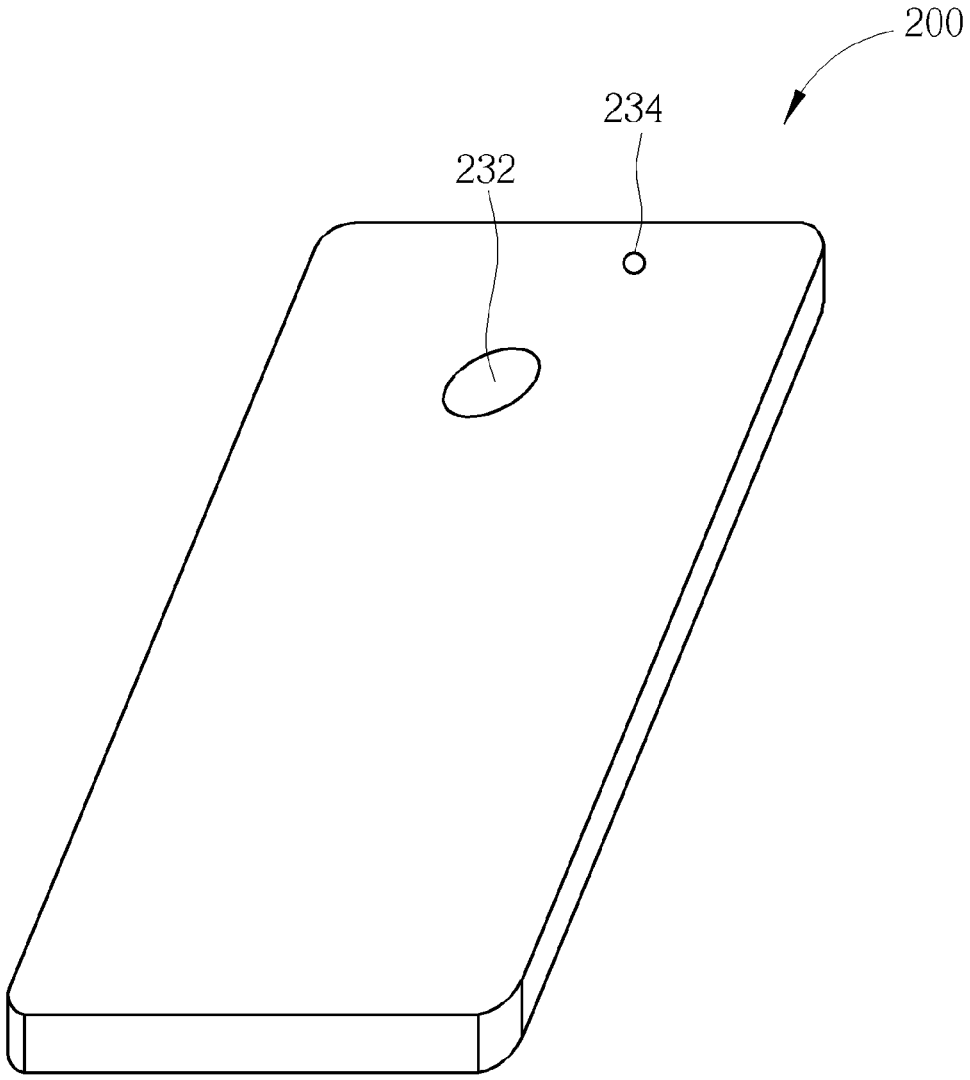

FIGS. 2-3 illustrate some implementation details of the apparatus 100 shown in FIG. 1 according to an example, where the apparatus of this example is a mobile phone 200 equipped with multiple light sensors 231, 232, 233, and 234, which can be taken as examples of the light sensor 130 shown in FIG. 1, and the touch-sensitive display panel 240 shown in FIG. 2 can be taken as an example of the display panel 120 shown in FIG. 1.

The light sensors 231 and 232 of this example are camera modules that can be utilized as ambient light sensors in some situations, respectively, and the light sensors 233 and 234 of this example can be ambient light sensors. In the example shown in FIGS. 2-3, the camera module 231 is a front camera module that is capable of capturing images of the surroundings in front of the mobile phone 200, and the camera module 232 is a main camera module that is capable of capturing images of the surroundings at the other side of the mobile phone 200. For example, the processing circuit 110 (more particularly, the processing circuit 110 executing the program code 112 such as the application, the operating system and the hardware drivers mentioned above) may selectively control one or more of the camera modules 231 and 232 to capture one or more images, or selectively control one or more of the camera modules 231 and 232 to be utilized as ambient light sensors in some situations, for use of the aforementioned ambient light brightness detection. In practice, brightness detection level calibration and/or data conversion may be needed for the camera modules 231 and 232 when they are utilized as ambient light sensors during the ambient light brightness detection mentioned above.

Figure 4:
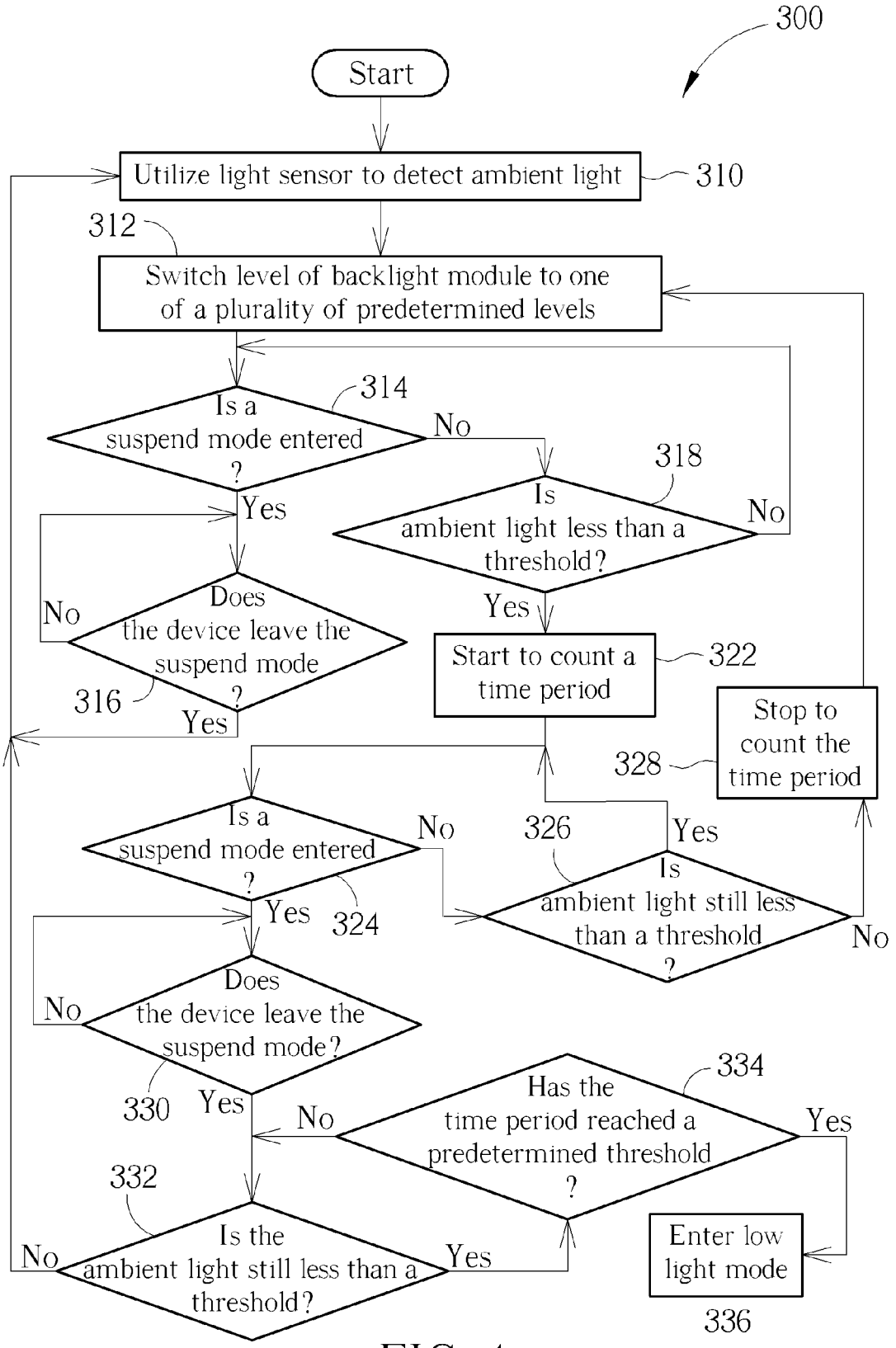
FIG. 4 illustrates a flowchart of a method for adjusting display backlight according to an example.

FIG. 4 illustrates a flowchart of a method 300 for adjusting display backlight according to an example. The method shown in FIG. 4 can be applied to the apparatus 100 shown in FIG. 1 (more particularly, the mobile phone 200 of the example shown in FIGS. 2-3), and can be applied to the processing circuit 110 thereof (more particularly, the processing circuit 110 executing the program code 112 such as the application, the operating system and the hardware drivers mentioned above). For example, the program code 112 may be provided through a computer program product having program instructions for instructing a processor such as that mentioned above to perform the method 300 shown in FIG. 4, where the computer program product may be implemented as a non-transitory computer-readable medium (e.g. a floppy disk or a compact disc-read only memory (CD-ROM)) storing the program instructions or an equivalent version thereof, such as a software package for being installed. The method is described as follows.

In Step 310, the processing circuit 110 utilizes the light sensor 130 of the electronic device to detect the ambient light brightness. In practice, the processing circuit 110 may utilize the light sensor 130 to detect the ambient light brightness at different time points to obtain a plurality of light sensor values corresponding to the time points, respectively. For example, one or more of the light sensor values can be obtained in a situation where the electronic device is in suspend mode (e.g. also called sleep mode which is usually with display off). In another example, each of the light sensor values can be obtained in a situation where the electronic device is not in the suspend mode.

In Step 312, the brightness level of the backlight module 122 of the display panel 120 is switched to be one of a plurality of predetermined levels of an automatic backlight mode in response to the ambient light brightness. In the following steps, the processing circuit 110 performs a plurality of detection operations to selectively control the electronic device to enter the specific mode to adjust the brightness level of the backlight module 122 of the display panel 120 of the electronic device mentioned above. More particularly, the plurality of detection operations may comprises: detecting whether the ambient light brightness is less than a predetermined ambient brightness threshold value Ambient_Brightness_Th for a time period; and detecting whether the length of the time period reaches a predetermined time threshold value Time_Th (e.g. a few tens of minutes). In practice, in a situation where the processing circuit 110 utilizes the light sensor 130 to detect the ambient light brightness at the aforementioned different time points to obtain the plurality of light sensor values corresponding to the time points, respectively, the processing circuit 110 may compare the light sensor values with the predetermined ambient brightness threshold value Ambient_Brightness_Th, respectively, to determine whether the ambient light brightness is less than the predetermined ambient brightness threshold value Ambient_Brightness_Th at the time points, respectively.

In Step 314, it is determined whether a suspend mode has been entered. If yes, the flow proceeds to Step 316, wherein it is determined whether the device subsequently exits the suspend mode. If so, the flow returns to Step 310, and the ambient light brightness is detected once more. If the determination at Step 314 is that the device has not entered a suspend mode, the flow proceeds to Step 318, and it is determined whether the ambient light brightness level is less than a predetermined ambient brightness threshold value (i.e. whether the electronic device has entered a dark environment). If so, the flow proceeds to Step 322 and the electronic device starts to count a time period. If the device has not entered a dark environment, the flow returns to Step 314. In Step 324, it is determined whether the device in the dark environment has entered a suspend mode. If not, the flow proceeds to Step 326, wherein it is again determined whether the ambient light brightness is less than the predetermined ambient brightness threshold value, i.e. is the device still in the dark environment. If yes, the flow returns to Step 324. If not, the flow proceeds to Step 328, wherein the device stops counting the time period, and then returns to Step 312. If the determination of Step 324 is that the device has entered a suspend mode, in Step 330 it is determined whether the device has left the suspend mode. If yes, it is again determined whether the ambient light brightness is less than the predetermined ambient brightness threshold value, i.e. is the device still in the dark environment. If the determination is no, the flow returns to Step 310. If it is determined the device is still in the dark environment, the flow proceeds to Step 334, wherein it is determined whether the time period has reached a predetermined time threshold value. If yes, the flow proceeds to Step 336 and the low light mode is entered.

For example, when it is detected that the ambient light brightness is less than the predetermined ambient brightness threshold value Ambient_Brightness_Th for the time period and that the length of the time period reaches the predetermined time threshold value Time_Th, the processing circuit 110 controls the electronic device to enter the specific mode, where the predetermined ambient brightness threshold value corresponds to the minimum level of a plurality of predetermined levels L(1), L(2), . . . , and L(N) of an automatic backlight mode of the electronic device. More particularly, the plurality of detection operations may further comprise determining whether the ambient light brightness during the time period is stably in a range corresponding to one of the plurality of predetermined levels L(1), L(2), . . . , and L(N) of the automatic backlight mode, and when it is detected that the ambient light brightness during the time period is stably in a range corresponding to one of the plurality of predetermined levels L(1), L(2), . . . , and L(N) of the automatic backlight mode, the processing circuit 110 controls the electronic device to enter the specific mode. In another example, the plurality of detection operations may further comprise detecting whether the system time of the electronic device is within a predetermined time interval of a day, such as the time interval that the user is supposedly sleeping (e.g. the eight hours from 10:00 PM through to 06:00 AM, or the five hours from 00:00 AM through to 05:00 AM), and when it is detected that the ambient light brightness is less than the predetermined ambient brightness threshold value Ambient_Brightness_Th for the time period and that the length of the time period reaches the predetermined time threshold value Time_Th and that the system time of the electronic device is within the aforementioned predetermined time interval of the day, the processing circuit 110 controls the electronic device to enter the specific mode. Please note that the predetermined time interval mentioned above can be defined in advance according to default settings and/or user settings.

In addition, for example, the specific mode mentioned above can be a low-light mode of the electronic device, and when the electronic device is in the low-light mode, the processing circuit 110 may control the brightness level of the backlight module 122 of the display panel 120 to a predetermined backlight brightness threshold value Backlight_Brightness_Th. For example, the predetermined backlight brightness threshold value Backlight_Brightness_Th is less than the minimum level of the plurality of predetermined levels L(1), L(2), . . . , and L(N) of the automatic backlight mode. More particularly, when the electronic device is in the automatic backlight mode of the electronic device, the processing circuit 110 controls the brightness level of the backlight module 122 to automatically switch to be one of the plurality of predetermined levels L(1), L(2), . . . , and L(N) of the automatic backlight mode, such as the predetermined levels L(n), in response to the ambient light brightness, where the notation N may represent a positive integer that is greater than one, and the notation n may represent an index falling within the range of the interval [1, N]. Typically, the predetermined backlight brightness threshold value Backlight_Brightness_Th is less than the minimum level of the plurality of predetermined levels L(1), L(2), . . . , and L(N) of the automatic backlight mode. Please note that the electronic device may exit the low-light mode under control of the processing circuit 110. For example, in a situation where the electronic device is in the low-light mode, when it is detected that the ambient light brightness reaches or is over the predetermined ambient brightness threshold value Ambient_Brightness_Th, the processing circuit 110 may control the electronic device to exit the low-light mode and to enter the automatic backlight mode mentioned above to control the brightness level of the backlight module 122 to be one of the plurality of predetermined levels L(1), L(2), . . . , and L(N). In another example, in a situation where the electronic device is in the low-light mode, when it is detected that the ambient light brightness reaches or is over the predetermined ambient brightness threshold value Ambient_Brightness_Th, the processing circuit 110 may control the electronic device to exit the low-light mode and may further control the brightness level of the backlight module 122 to be one of the plurality of predetermined levels L(1), L(2), . . . , and L(N) according to automatic backlight mode setting.

Figure 5:
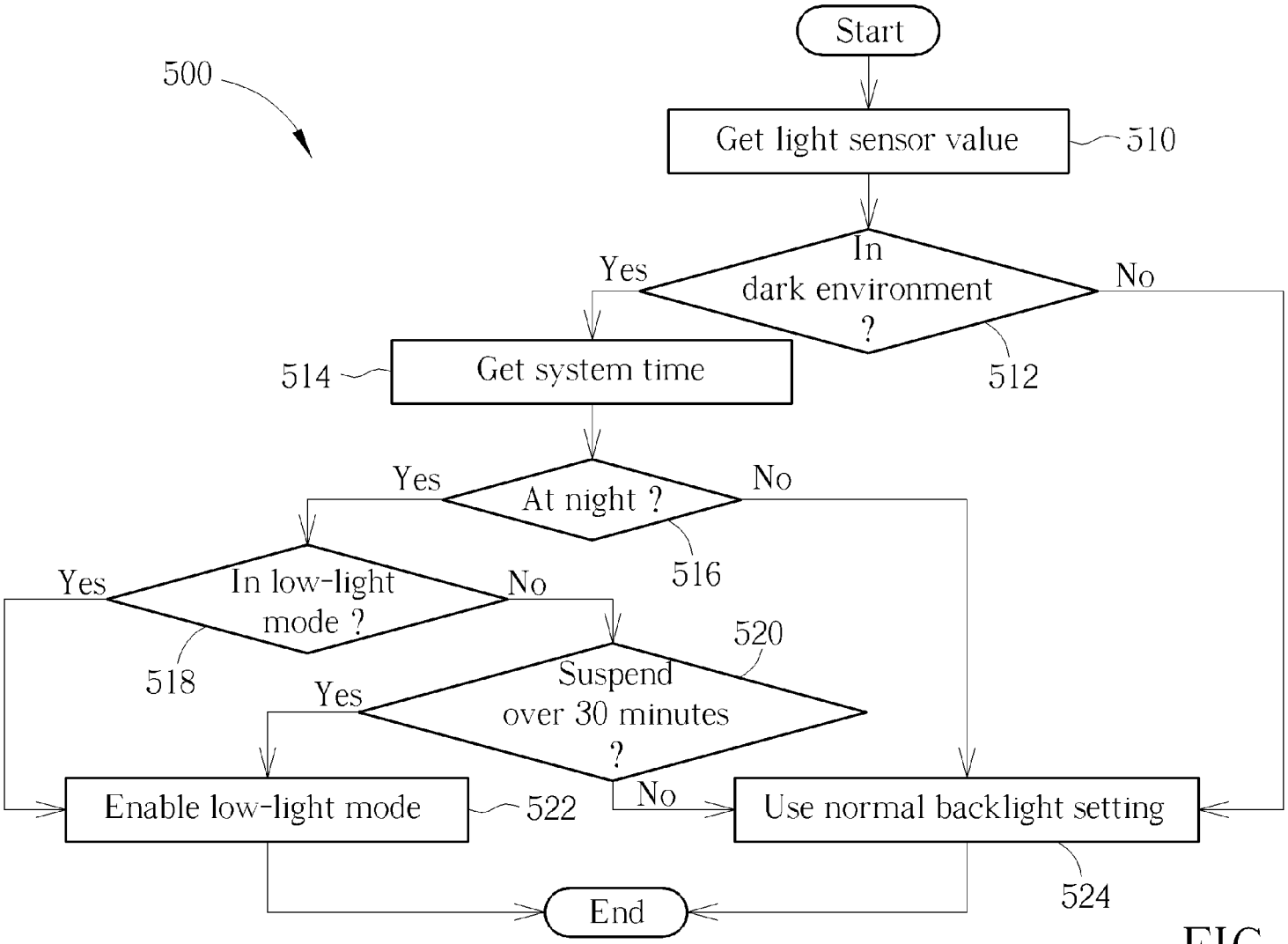
FIG. 5 illustrates a working flow involved with the method shown in FIG. 4 according to an example.

FIG. 5 illustrates a working flow 500 involved with the method 300 shown in FIG. 4 according to an example, where the working flow 500 can be applied to the apparatus 100 when the electronic device resumes from the suspend mode.

In Step 510, the processing circuit 110 gets a light sensor value, such as one of the light sensor values mentioned above.

In Step 512, the processing circuit 110 checks whether the electronic device is in dark environment, for example, by checking using the predetermined ambient brightness threshold value Ambient_Brightness_Th, and more particularly, by comparing the ambient light brightness with the predetermined ambient brightness threshold value Ambient_Brightness_Th. When it is detected that the electronic device is in dark environment, Step 514 is entered; otherwise, Step 524 is entered.

In Step 514, the processing circuit 110 gets the system time (e.g. the system time obtained from the system clock).

In Step 516, the processing circuit 110 checks whether the system time is during the predetermined time interval mentioned above, such as the time interval that the user is supposedly sleeping (labeled "At night" in FIG. 5, for better comprehension). When it is detected that the system time is during the predetermined time interval, Step 518 is entered; otherwise, Step 524 is entered.

In Step 518, the processing circuit 110 checks whether the electronic device is in the low-light mode. When it is detected that the electronic device is in the low-light mode, Step 522 is entered; otherwise, Step 520 is entered.

In Step 520, the processing circuit 110 checks whether the length of the time period (i.e. the time period mentioned in the plurality of detection operations of Step 320) reaches the predetermined time threshold value Time_Th, and more particularly, checks whether the electronic device suspends over thirty minutes. When it is detected that the electronic device suspends over thirty minutes, Step 522 is entered; otherwise, Step 524 is entered.

In Step 522, the processing circuit 110 enables the low-light mode. When the electronic device is in the low-light mode, the processing circuit 110 may control the brightness level of the backlight module 122 of the display panel 120 to be equal to or less than the predetermined backlight brightness threshold value Backlight_Brightness_Th.

In Step 524, the processing circuit 110 uses the normal backlight setting. For example, the processing circuit 110 may use the normal backlight setting of the automatic backlight mode.

In this example, after any of Step 522 and Step 524 is performed, the backlight setting of the working flow 500 can be finished.

Figure 6:
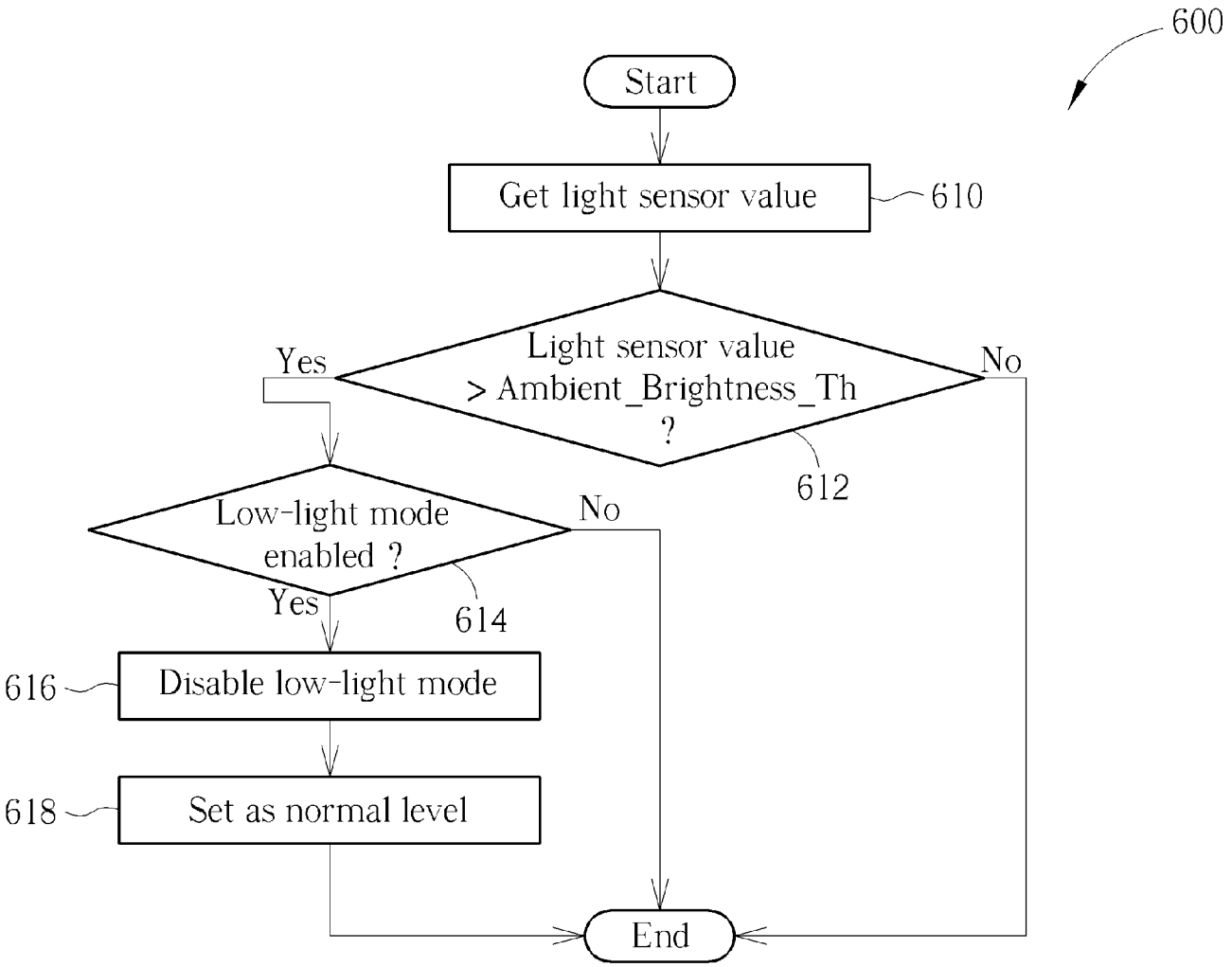
FIG. 6 illustrates a working flow involved with the method shown in FIG. 4 according to another example.

FIG. 6 illustrates a working flow 600 involved with the method 300 shown in FIG. 4 according to another example, where the working flow 600 can be applied to the apparatus 100 when the ambient light brightness changes.

In Step 610, the processing circuit 110 gets a light sensor value, such as one of the light sensor values mentioned above.

In Step 612, the processing circuit 110 checks whether the light sensor value is greater than the predetermined ambient brightness threshold value Ambient_Brightness_Th. When it is detected that the light sensor value is greater than the predetermined ambient brightness threshold value Ambient_Brightness_Th, Step 614 is entered; otherwise, the working flow 600 comes to the end.

In Step 614, the processing circuit 110 checks whether the low-light mode has been enabled. When it is detected that the low-light mode has been enabled, Step 616 is entered; otherwise, the working flow 600 comes to the end.

In Step 616, the processing circuit 110 disables the low-light mode.

In Step 618, the processing circuit 110 sets the backlight as a normal level, and more particularly, controls the brightness level of the backlight module 122 to automatically switch to be one of a plurality of predetermined levels L(1), L(2), . . . , and L(N) of the automatic backlight mode.

In this example, when the operation of Step 618 is completed or the checking result of any of Step 612 and Step 614 is "No", the backlight setting of the working flow 600 can be finished.

Figure 7:
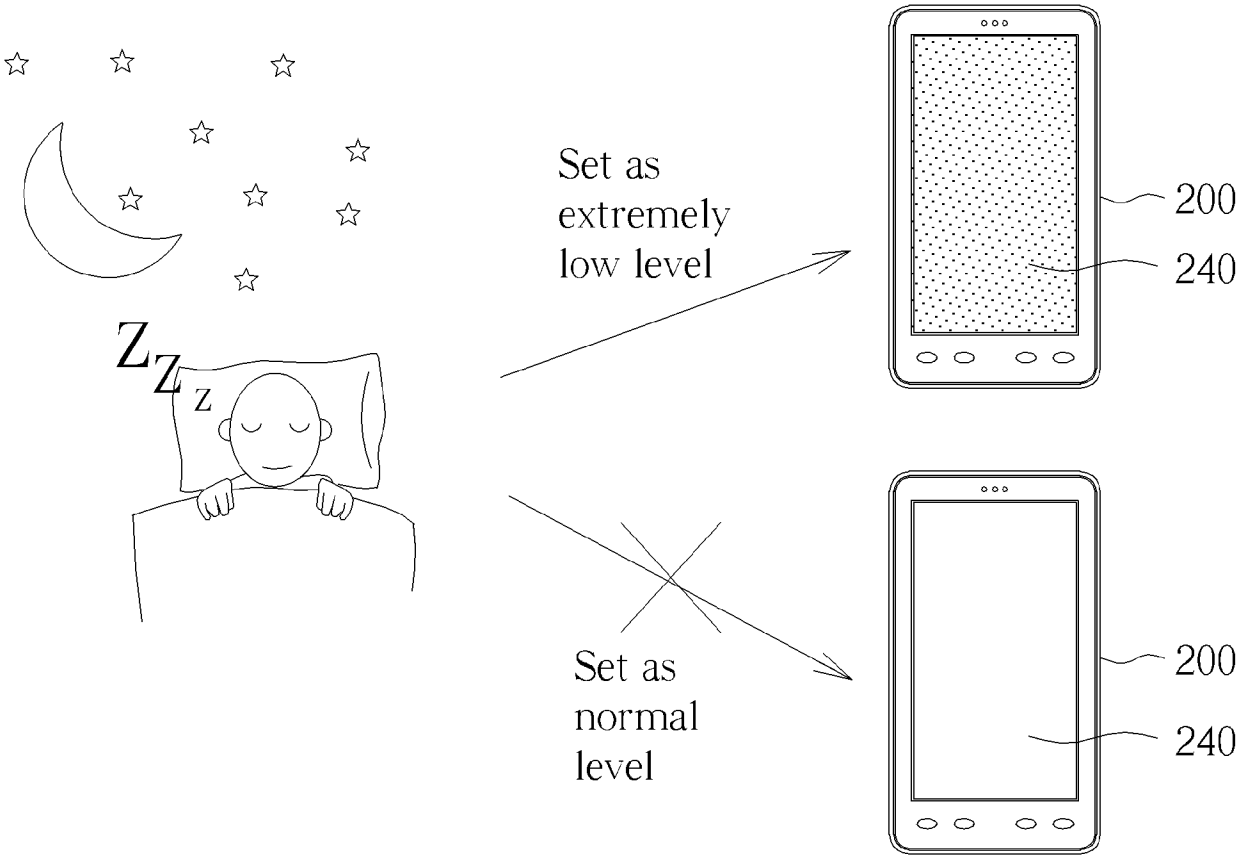
FIG. 7 illustrates a backlight control scheme involved with the method shown in FIG. 4 according to an example.

FIG. 7 illustrates a backlight control scheme involved with the method 300 shown in FIG. 4 according to an example, where the user is sleeping at night. For example, when there is an incoming phone call such as that mentioned above, the electronic device resumes from the suspend mode as in the example shown in FIG. 5. During the detection operations mentioned above, when it is detected that it is midnight, for example, the processing circuit 110 sets the backlight as an extremely low level such as that mentioned above, rather than setting the backlight as the normal level mentioned in Step 618, where the extremely low level is equal to or less than the predetermined backlight brightness threshold value Backlight_Brightness_Th.

Figure 8:
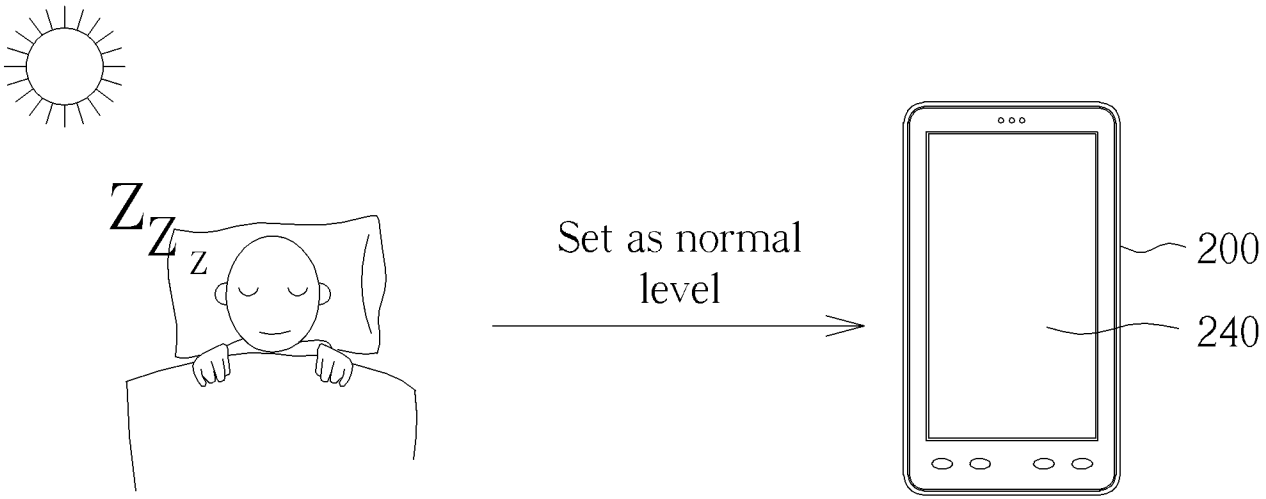
FIG. 8 illustrates a backlight control scheme involved with the method shown in FIG. 4 according to another example.

FIG. 8 illustrates a backlight control scheme involved with the method 300 shown in FIG. 4 according to another example, where the user might not be in sleep time. For example, when there is an incoming phone call such as that mentioned above, the electronic device resumes from the suspend mode as in the example shown in FIG. 5. During the detection operations mentioned above, when it is detected that it is at noon (not a normal sleep time), for example, the processing circuit 110 sets the backlight as the normal level mentioned in Step 618.

According to an aspect, the aforementioned computer program product can be composed of several code segments. In addition, after these code segments are loaded into the apparatus 100 (more particularly, the processing circuit 110) and are executed, the steps and features of the method shown in FIG. 4 can be implemented.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for adjusting display backlight, the method being applied to an electronic device, the method comprising the steps of:

utilizing at least one light sensor of the electronic device to detect ambient light brightness; and controlling a brightness level of a backlight module of a display panel of the electronic device to automatically switch to be one of a plurality of predetermined levels of an automatic backlight mode in response to the ambient light brightness before the electronic device enters a low light mode, and performing a plurality of detection operations to selectively control the electronic device to enter the low light mode to adjust the brightness level of the backlight module of the display panel of the electronic device, wherein the plurality of detection operations comprises:

before the electronic device enters a suspend mode wherein the display panel is off, starting to count a time period when the ambient light brightness is less than a predetermined ambient brightness threshold value;

after the electronic device enters the suspend mode and then subsequently leaves the suspend mode so that the display panel turns on, performing an ambient light detection operation to detect whether the ambient light brightness is less than the predetermined ambient brightness threshold value; and when the ambient light brightness in the ambient light detection operation is less than the predetermined ambient brightness threshold value, detecting the counted time period;

wherein when the counted time period reaches a predetermined time threshold value, the electronic device enters the low light mode.

2. The method of claim 1, wherein the predetermined ambient brightness threshold value corresponds to a minimum level of the plurality of predetermined levels of the automatic backlight mode.

3. The method of claim 1, wherein the plurality of detection operations further comprises determining whether the ambient light brightness during the counted time period is stably in a range corresponding to one of a plurality of predetermined levels of the automatic backlight mode; and the step of performing the plurality of detection operations to selectively control the electronic device to enter the low-light mode further comprises:

when it is detected that the ambient light brightness during the counted time period is stably in a range corresponding to one of the plurality of predetermined levels of the automatic backlight mode, controlling the electronic device to enter the low-light mode.

4. The method of claim 1, wherein the plurality of detection operations further comprises detecting whether a system time of the electronic device is within a predetermined time interval of a day; and the step of performing the plurality of detection operations to selectively control the electronic device to enter the low-light mode further comprises:

when it is detected that the ambient light brightness is less than the predetermined ambient brightness threshold value for the counted time period and that the length of the counted time period reaches the predetermined time threshold value and that the system time of the electronic device is within the predetermined time interval of the day, controlling the electronic device to enter the low-light mode.

5. The method of claim 1, further comprising:

when the electronic device is in the low-light mode, controlling the brightness level of the backlight module of the display panel to a predetermined backlight brightness threshold value;

wherein the predetermined backlight brightness threshold value is less than a minimum level of the plurality of predetermined levels of the automatic backlight mode.

6. The method of claim 5, further comprising:

in a situation where the electronic device is in the low-light mode, when it is detected that the ambient light brightness reaches the predetermined ambient brightness threshold value, controlling the electronic device to exit the low-light mode and enter the automatic backlight mode to control the brightness level of the backlight module to be one of the plurality of predetermined levels.

7. The method of claim 1, wherein the step of utilizing the at least one light sensor of the electronic device to detect the ambient light brightness further comprises:

utilizing the at least one light sensor to detect the ambient light brightness at different time points to obtain a plurality of light sensor values corresponding to the time points, respectively;

wherein the step of performing the plurality of detection operations to selectively control the electronic device to enter the low-light mode further comprises:

comparing the light sensor values with the predetermined ambient brightness threshold value, respectively, to determine whether the ambient light brightness is less than the predetermined ambient brightness threshold value at the time points, respectively.

8. The method of claim 1, wherein the plurality of detection operations selectively control the electronic device to enter the low light mode to adjust the brightness level of the backlight module of the display panel of the electronic device to be less than a minimum level of the plurality of predetermined levels of the automatic backlight mode.

9. The method of claim 1, wherein when the ambient light brightness in the ambient light detection operation is less than the predetermined ambient brightness threshold value and the same as the ambient light brightness before entering the suspend mode, the counted time period is detected.

10. An apparatus for adjusting display backlight, the apparatus comprises at least one portion of an electronic device, the apparatus comprising:

a display panel arranged to display information for the electronic device;

at least one light sensor arranged to detect ambient light brightness for the electronic device; and a processing circuit, coupled to the display panel and the at least one light sensor, arranged to control operations of the electronic device, wherein the processing circuit controls a brightness level of a backlight module of the display panel to automatically switch to be one of a plurality of predetermined levels of an automatic backlight mode in response to the ambient light brightness before the electronic device enters a low light mode, wherein the processing circuit performs a plurality of detection operations to selectively control the electronic device to enter the low light mode to adjust the brightness level of the backlight module of the display panel, wherein the plurality of detection operations comprises:

before the electronic device enters a suspend mode wherein the display panel is off, starting to count a time period when the ambient light brightness is less than a predetermined ambient brightness threshold value;

after the electronic device enters the suspend mode and then subsequently leaves the suspend mode so that the display panel turns on, performing an ambient light detection operation to detect whether the ambient light brightness is less than the predetermined ambient brightness threshold value; and when the ambient light brightness in the ambient light detection operation is less than the predetermined ambient brightness threshold value, detecting the counted time period;

wherein when the counted time period reaches a predetermined time threshold value, the electronic device enters the low light mode.

11. The apparatus of claim 10, wherein the predetermined ambient brightness threshold value corresponds to a minimum level of the plurality of predetermined levels of the automatic backlight mode.

12. The apparatus of claim 10, wherein the plurality of detection operations further comprises determining whether the ambient light brightness during the counted time period is stably in a range corresponding to one of a plurality of predetermined levels of the automatic backlight mode; and when it is detected that the ambient light brightness during the counted time period is stably in a range corresponding to one of the plurality of predetermined levels of the automatic backlight mode, the processing circuit controls the electronic device to enter the low light mode.

13. The apparatus of claim 10, wherein the plurality of detection operations further comprises detecting whether a system time of the electronic device is within a predetermined time interval of a day; and when it is detected that the ambient light brightness is less than the predetermined ambient brightness threshold value for the counted time period and that the length of the counted time period reaches the predetermined time threshold value and that the system time of the electronic device is within the predetermined time interval of the day, the processing circuit controls the electronic device to enter the low light mode.

14. The apparatus of claim 10, when the electronic device is in the low-light mode, the processing circuit controls the brightness level of the backlight module of the display panel to a predetermined backlight brightness threshold value, wherein the predetermined backlight brightness threshold value is less than a minimum level of the plurality of predetermined levels of the automatic backlight mode.

15. The apparatus of claim 14, wherein, in a situation where the electronic device is in the low-light mode, when it is detected that the ambient light brightness reaches the predetermined ambient brightness threshold value, the processing circuit controls the electronic device to exit the low-light mode and enter the automatic backlight mode to control the brightness level of the backlight module to be one of the plurality of predetermined levels.

16. The apparatus of claim 10, wherein the processing circuit utilizes the at least one light sensor to detect the ambient light brightness at different time points to obtain a plurality of light sensor values corresponding to the time points, respectively; and the processing circuit compares the light sensor values with the predetermined ambient brightness threshold value, respectively, to determine whether the ambient light brightness is less than the predetermined ambient brightness threshold value at the time points, respectively.

17. A computer program product, having program instructions for instructing a processor of an electronic device to perform a method comprising the steps of:

utilizing at least one light sensor of the electronic device to detect ambient light brightness; and controlling a brightness level of a backlight module of a display panel of the electronic device to automatically switch to be one of a plurality of predetermined levels of an automatic backlight mode in response to the ambient light brightness before the electronic device enters a low light mode, and performing a plurality of detection operations to selectively control the electronic device to enter the low light mode to adjust the brightness level of the backlight module of the display panel of the electronic device, wherein the plurality of detection operations comprises:

before the electronic device enters a suspend mode wherein the display panel is off, starting to count a time period when the ambient light brightness is less than a predetermined ambient brightness threshold value;

after the electronic device enters the suspend mode and then subsequently leaves the suspend mode so that the display panel turns on, performing an ambient light detection operation to detect whether the ambient light brightness is less than the predetermined ambient brightness threshold value; and when the ambient light brightness in the ambient light detection operation is less than the predetermined ambient brightness threshold value, detecting the counted time period;

wherein when the counted time period reaches a predetermined time threshold value, the electronic device enters the low light mode.

* * * * *